US005659915A

United States Patent [19]

Dhingra et al.

[11] Patent Number: 5,659,915

[45] Date of Patent: Aug. 26, 1997

[54] OFF GAS FILM COOLER CLEANER

[75] Inventors: Hardip S. Dhingra, Williamsville; William C. Koch, Gowanda, both of N.Y.; David C. Burns, Trafford, Pa.

[73] Assignee: United States Department of Energy, Washington, D.C.

[21] Appl. No.: 542,756

[22] Filed: Oct. 13, 1995

[51] Int. Cl.[6] ..... B08B 9/02

[52] U.S. Cl. ..... 15/104.095; 15/104.09; 15/246.5

[58] Field of Search ..... 15/88, 104.05, 15/104.09, 104.095, 104.096, 104.11, 104.12, 104.16, 104.2, 104.066, 104.067, 246.5, 249.1

[56] References Cited

U.S. PATENT DOCUMENTS

| | | | |
|---|---|---|---|
| 271,358 | 1/1883 | Pike | 15/104.09 X |
| 430,767 | 6/1890 | Brady | 15/104.095 |
| 473,821 | 4/1892 | Carbis | 15/104.095 |
| 572,037 | 11/1896 | Voorhees | 15/104.095 |
| 855,297 | 5/1907 | Fitzgerald | 15/104.095 |
| 1,616,777 | 2/1927 | Booth | 15/104.09 X |
| 1,689,277 | 10/1928 | Burns | 15/104.066 X |
| 1,694,371 | 12/1928 | Burbick | 15/104.095 X |
| 2,115,439 | 4/1938 | Wolfner | 15/104.096 X |
| 2,746,535 | 5/1956 | Barroso | 15/104.095 X |
| 3,996,637 | 12/1976 | Shibata et al. | 15/104.096 X |
| 4,490,876 | 1/1985 | Haberl . | |

FOREIGN PATENT DOCUMENTS

| | | | |
|---|---|---|---|
| 1001810 | 12/1976 | Canada | 15/104.095 |
| 594582 | 7/1925 | France | 15/104.09 |
| 282582 | 3/1915 | Germany | 15/88 |
| 47-15594 | 5/1972 | Japan | 15/104.096 |
| 12012 | 6/1899 | United Kingdom | 15/104.095 |

*Primary Examiner*—Mark Spisich

*Attorney, Agent, or Firm*—Timothy L. Harney; Robert J. Fisher; William R. Moser

[57] ABSTRACT

An apparatus for cleaning depositions of particulate matter from the inside of tubular piping while the piping is in use. The apparatus is remote controlled in order to operate in hazardous environments. A housing containing brush and shaft assemblies is mounted on top of the tubular piping. Pneumatic cylinders provide linear motion. A roller nut bearing provides rotary motion. The combined motion causes the brush assembly to rotate as it travels along the tube dislodging particulate matter.

12 Claims, 4 Drawing Sheets

OFF GAS FILM COOLER CLEANER

CONTRACTUAL ORIGIN OF THE INVENTION

The United States Government has rights in this invention pursuant to Contract Number DE-AC07-81NE44139 between the United States Government and West Valley Nuclear Services Co. Inc.

BACKGROUND OF THE INVENTION

The present invention relates generally to the interior cleaning of a tubular member and more particularly to the cleaning of the off gas cooler of a vitrification unit.

Vitrification plants have been designed to solidify radioactive waste resulting from nuclear fuel reprocessing. A vitrification unit mixes radioactive and other waste with the components of borosilicate glass, melts the mixture at high temperatures for periods of time, and pours it into stainless steel canisters for storage. Due to the radiation and high temperatures, most major components in the unit are remotely removable using only crane mounted equipment. All piping and electrical connections to these components also use crane removable jumpers. All operations are remotely monitored to protect workers and prevent the release of pollutants. In addition to shield windows, operations are monitored by camera.

Any radioactive emissions from the heated mixture in the vitrification unit are drawn by vacuum into the Off Gas Treatment system. The In-cell section of the system can consist of a film cooler, submerged bed scrubber with mist eliminator, and mist eliminator preheaters. Gaseous emissions are quenched, scrubbed to remove radioactive particulate matter, then passed through the mist eliminator to remove liquid droplets. Gases are then heated and passed through the high efficiency mist eliminators to remove submicron particulate matter. From the In-cell treatment section, gases flow into the Ex-cell treatment section for filtration and catalytic reduction.

Substantial operational difficulties have been encountered due to radioactive particulate matter precipitating in the In-cell Off Gas Treatment piping. Plugging of the pipes has resulted in premature termination of a rim, with increased risk of release of emissions and endangerment of workers. There is a need to remove particle build-up during operation to avoid premature termination of operations which the present invention addresses.

SUMMARY OF THE INVENTION

An object of the present invention is to clean the interior surfaces of a tubular member.

Another object is to continually clean the tubular member without disassembling the piping in order to limit likelihood of release of radioactive matter and pollutants into the environment or cause worker contamination.

Another object is to continually clean the piping during operation of the unit.

Another object of the present invention is to provide a pipe cleaning apparatus in a radioactive environment.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

Briefly, the invention is an apparatus for cleaning interior surfaces of a tubular member while the member is in use. The invention comprises a brush and shaft assembly joined to a second shaft assembly which provides rotary motion. The second shaft assembly is joined to a means for providing linear motion. By means of linear and rotary motion the brush is propelled along the interior surface of the tubular member, removing particulate deposit as it travels the length of the member.

The apparatus may also have a set of brushes attached to the internal wall of the housing for cleaning the brush and shaft assembly. The second shaft assembly may have a roller nut bearing to provide rotary motion and have a grooved shaft to fit within the nut bearing. The linear motion may be provided by pneumatic cylinders connected to a wheel assembly. The wheel assembly transfers the linear motion to the second shaft assembly while allowing the second shaft assembly to rotate.

The accompanying drawings, which are incorporated in and form a part of the specification, illustrate the preferred embodiment of the present invention and, together with the description, serve to explain the principals of the invention.

BRIEF DESCRIPTION OF THE DRAWINGS

The present invention is illustrated in the drawings, wherein.

DETAILED DESCRIPTION OF THE INVENTION

Figure 1:
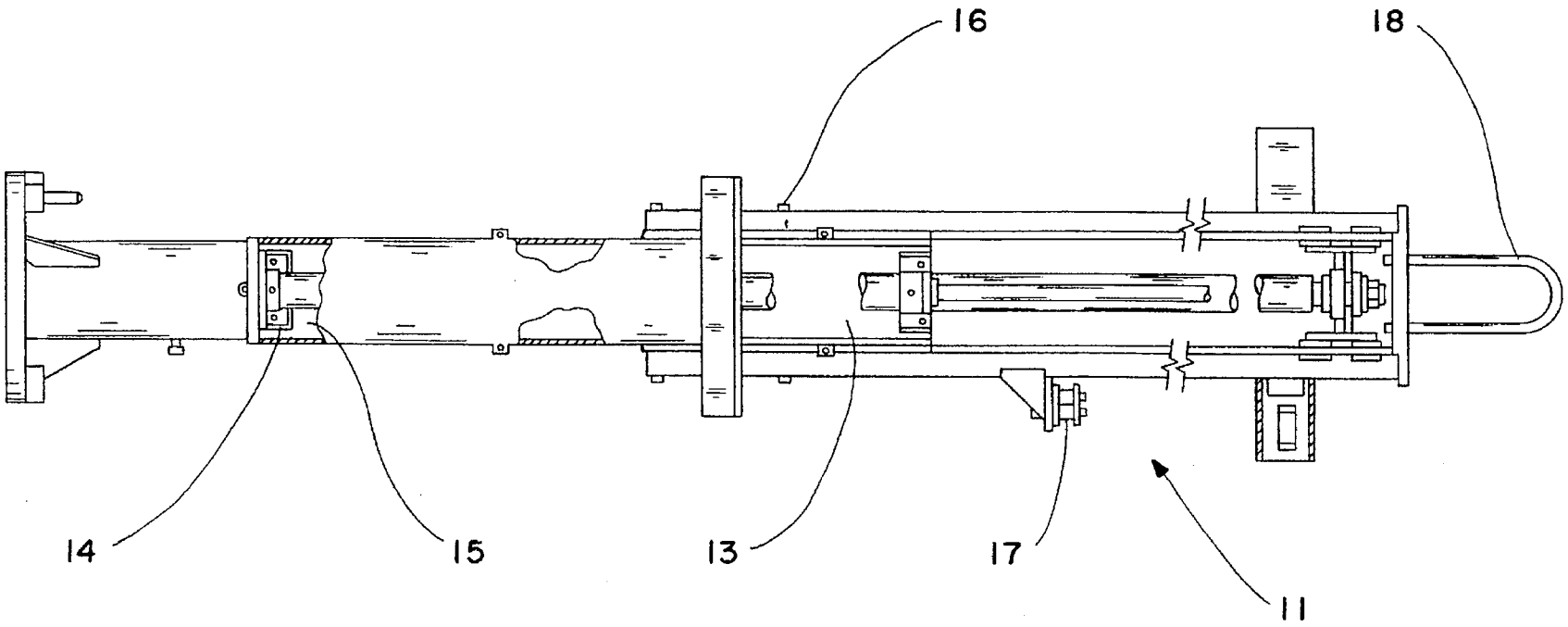
FIG. 1 is a partial cut away elevation view of a cleaning apparatus for a tubular member.

FIG. 1 shows a cleaning apparatus 11. The film cooler is shown as a partial cut away elevation view to disclose both the rest position 13 and the extended position 15 of the brush 14. As the brush assembly travels linearly between 13 and 15, the brush assembly rotates against the inside walls of the film cooler, thereby dislodging precipitated particulate matter from the inside walls of the film cooler. The dislodged matter falls into the vitrification unit (not shown) located directly under the film cooler. Vortex cooling air introduced through inlet 16 aids in forcing the dislodged matter into the vitrification unit.

FIG. 1 shows the connector for instrument air 17 and the lifting bail 18. The instrument air operates the pneumatic cylinders 28 shown in FIG. 2. The pneumatic cylinders provide linear motion to the brush. The connectors 16 and 17, as are all piping components, are designed to be removed and replaced by a remote control crane. The lifting bail 18 allows the entire cleaning apparatus to be removed or replaced as a unit thereby lessening the opportunity for the release of radioactive emissions.

Figure 2:
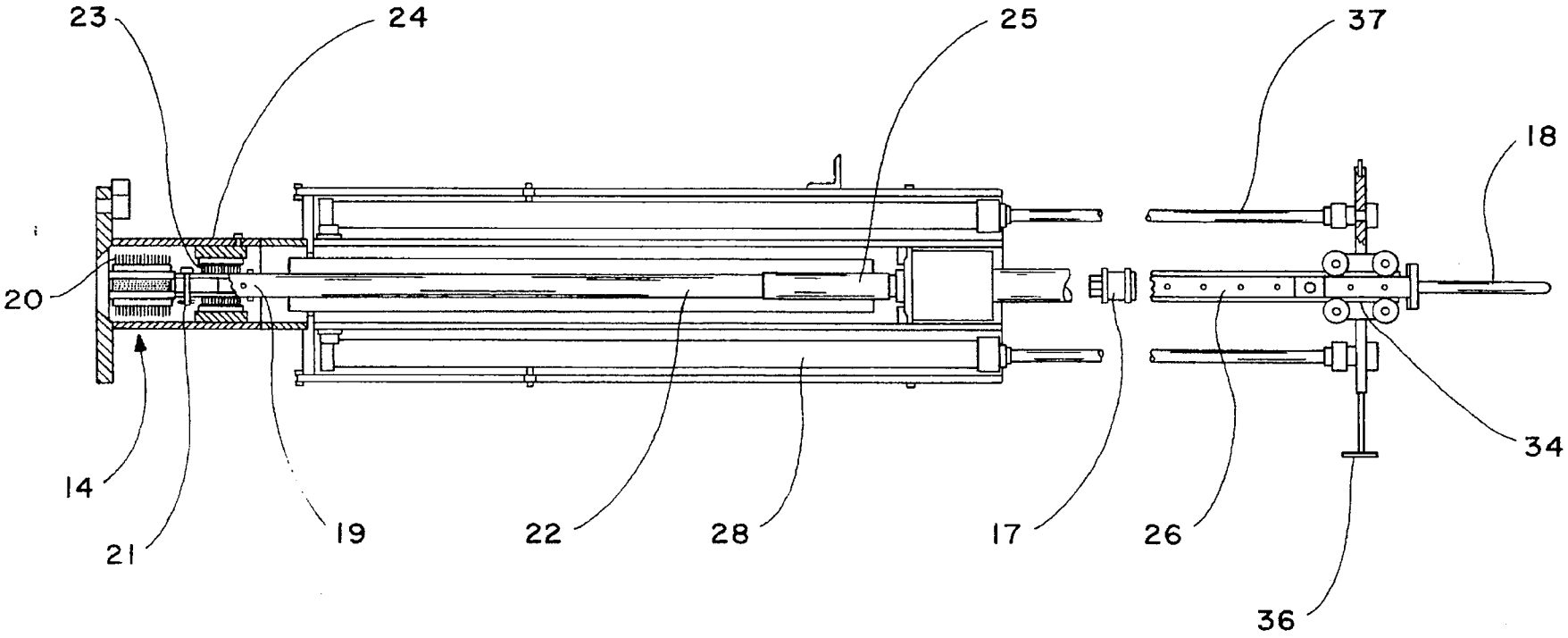
FIG. 2 is a cut away elevation view of the cleaning apparatus of FIG. 1 rotated 90°.
Figure 3:
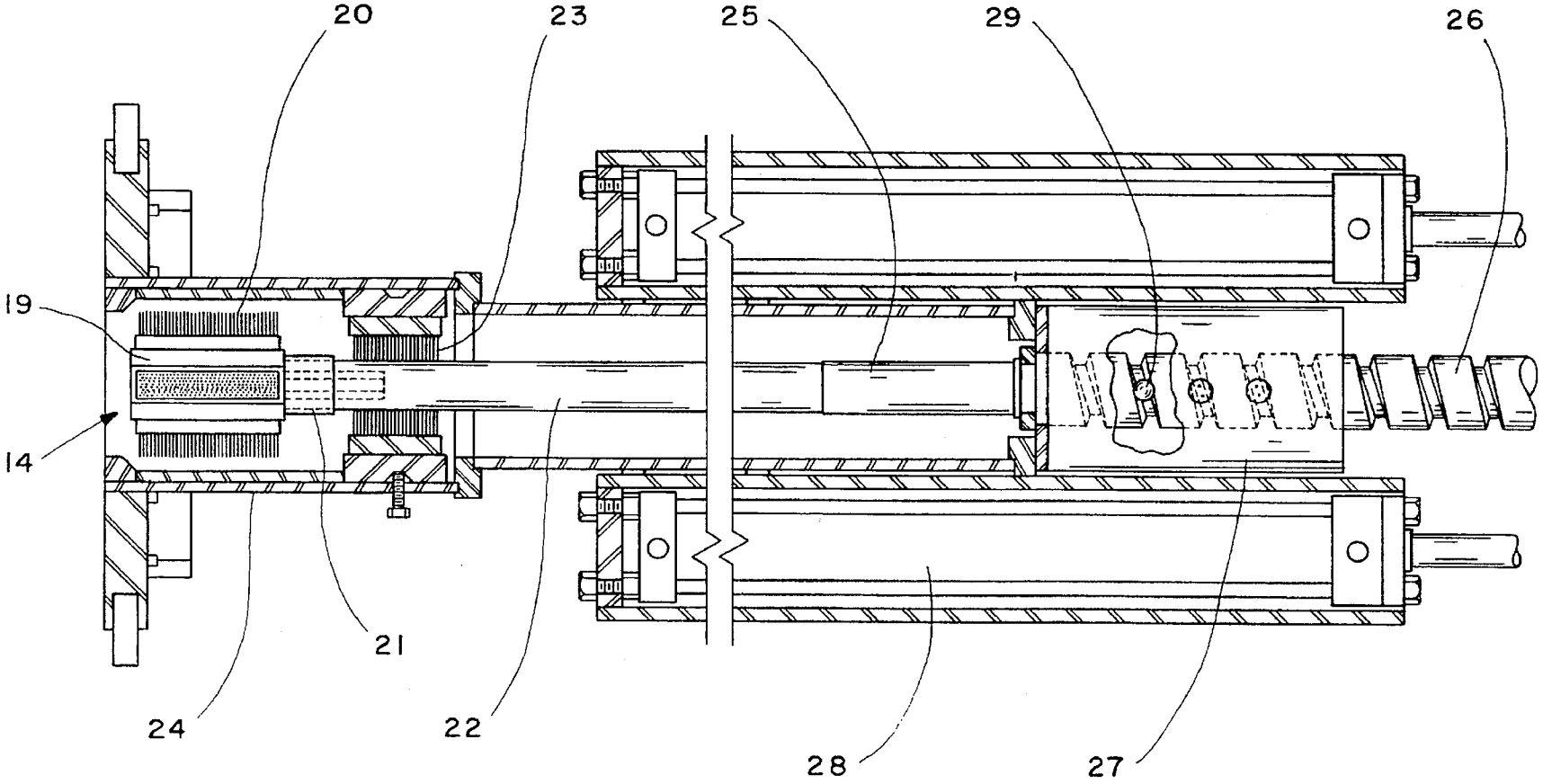
FIG. 3 is an enlarged sectional view of a portion of the cleaning apparatus of FIG. 2, further enlarged to FIG. 3.

FIGS. 2, and 3 show the brush assembly 14 comprising a cylinder 19 able to withstand temperatures of 1150° C. and radiation of 10,000 R/HR and four perpendicular sets of bristles of the same material 20 radiating outwardly to such a length that the bristles contact the inner surface of the film cooler. The brush assembly is attached to the first shaft 22 by a bolt and cotter pin 21. The shaft, bolt and cotter pin are also made of the same durable material. Attached to the interior wall of the housing 24 in such a manner that the bristles make contact with the surface of the first shaft 22 is a circular brush 23 with a plurality of radial bristles also of material able to withstand temperatures of 1150° C. and radiation of 10,000 R/HR. The circular brush removes any particulate matter on the first shaft.

Figure 4:
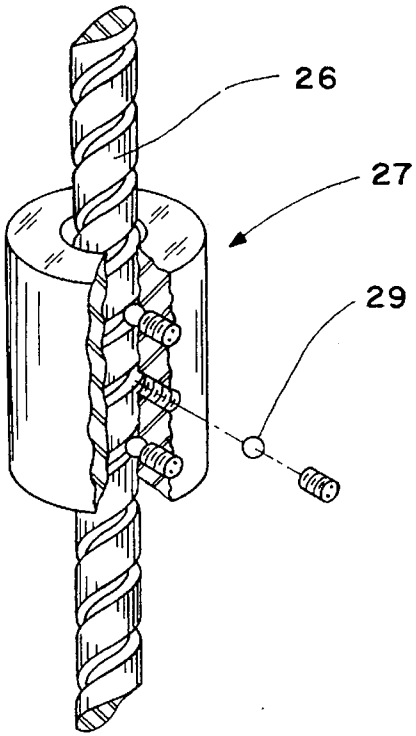
FIG. 4 is a perspective view, partially broken away, of a roller nut bearing.

The first shaft 22 is connected to the second shaft 26 by a weld joint 25. The second shaft 26 has a longitudinal spiral groove running along its outer surface. Above the weld joint the second shaft is encased in a roller nut bearing 27. FIG. 4 shows an expanded view of the bearing. Roller bearings 29 fit between the internal wall of the roller nut bearing and the inner wall of the spiral groove of the second shaft as shown in FIG. 3. As the second shaft passes through the roller nut bearing, the roller bearings cause the shaft to rotate. This rotary motion is translated along the first shaft to the brush assembly thereby causing the brush to rotate. The rotatory motion of the brush removes particulate matter from the walls of the film cooler.

Figure 5:
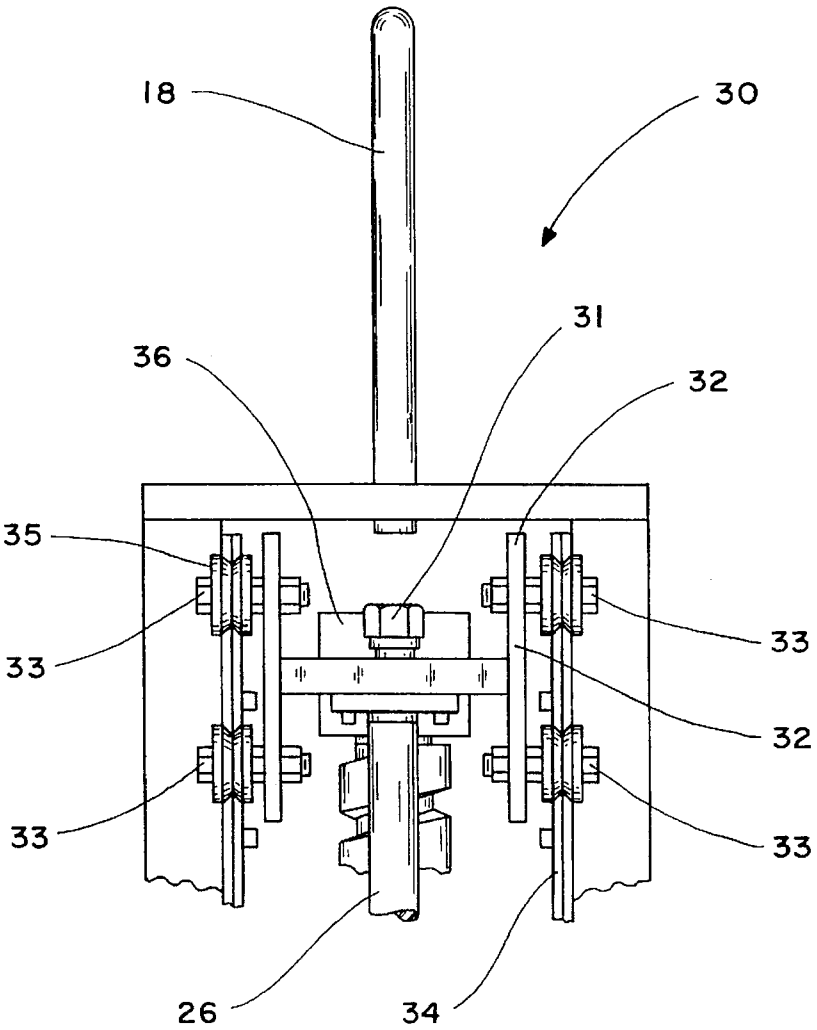
FIG. 5 is an enlarged sectional view of the upper portion of the cleaning apparatus of FIG. 2.

The second shaft 26 is connected to the wheel assembly 30 by bearing 31 as shown in FIG. 5. This bearing allows the second shaft to rotate within rigid support bracket 32 of the wheel assembly. Support bracket 32 is connected by bolts 33 to the wheel track 34. The wheel track provides alignment and support for the linear movement of the shafts and brush assembly as the wheels 35 travel linearly along the track. The support plate 36 is also connected to the wheel assembly by bearing 31. Pneumatic cylinder rods 37, shown in FIG. 2, are connected to the support plate. Linear motion provided by the cylinders 28 is transferred via the support plate to the wheel assembly and shafts to propel the brush along the interior of the tubular member.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principals of the invention and its practical application to thereby enable others skilled in the art to best utilize the invention in various embodiments and with various modifications as are suited to the particular use contemplated. It is intended that the scope of the invention be defined by the claims appended hereto.

The embodiment of this invention in which an exclusive property or privilege is claimed is defined as follows:

1. An apparatus for cleaning comprising:

a) a brush and shaft assembly including a brush at one end portion of the assembly, a first shaft portion supporting the brush and extending to engage a second shaft portion, and a weld joint coupling the first and second shaft portions;

b) means for imparting linear movement operably attached to the second shaft portion and a stationary nut means engaging and imparting rotary motion in conjunction with the linear movement of the second shaft portion; and c) a housing enclosing the brush and shaft assembly and means for imparting linear movement and having means for attaching them to an object to be cleaned whereby the linear-rotary movement of said second shaft portion and brush cleans the object.

2. The apparatus as recited in claim 1 wherein the brush comprises a series of bristles radiating outwardly from the first shaft portion.

3. The apparatus as recited in claim 1 wherein a circular brush is mounted to the housing so that the bristles thereof contact the surface of the first shaft portion.

4. The apparatus as recited in claim 1 wherein the brush assembly and first shaft portion are of a material able to withstand temperatures in the range from 600°–1150° C. without deforming.

5. The apparatus as recited in claim 1 wherein the brush assembly and first shaft portion are of a material able to withstand radiation in the range of 0–10,000 R/HR gamma radiation without deforming.

6. The apparatus as recited in claim 1 wherein the stationary nut means to provide rotary motion is a roller nut bearing having a central bore to fit the second shaft portion, a plurality of bearings situated between a spiral groove on the second shaft portion and the wall of the bore so that the second shaft portion rotates as it passes through the bearing.

7. The apparatus as recited in claim 6 wherein the spiral groove is between the weld joint and a top of the second shaft portion.

8. The apparatus as recited in claim 1 wherein the stationary nut means for providing linear motion is attached to the second shaft portion by a wheel assembly containing a plurality of bearings allowing the second shaft portion to rotate.

9. The apparatus as recited in claim 1 wherein an electrical circuit allows the apparatus to be operated from a remote control panel.

10. The apparatus as recited in claim 1 wherein the means for providing linear motion are a plurality of pneumatic cylinders, coupled to a source of pressurized air, venting into the housing to provide cooling.

11. The apparatus as recited in claim 10 wherein the attached pneumatic cylinders include pistons of sufficient area to deliver a minimum thrust of 1000 pounds at 80 psi.

12. An apparatus for cleaning comprising:

a) a brush assembly including a housing, a first brush attached to internal wall of the housing, and a second set of brushes attached to a shaft assembly;

b) the shaft assembly including a first shaft attached to said second set of brushes, a second shaft attached to the first shaft by a weld joint, the second shaft having a spiral groove between the weld joint and a wheel assembly so that it fits within a roller nut bearing;

c) the roller nut bearing having a central bore to fit the second shaft, a plurality of ball bearings situated between the spiral groove of the second shaft and the wall of the bore so that the second shaft rotates as it passes through the bearing;

d) the wheel assembly having a central bore to contain an end of the second shaft, a plurality of bearings to allow the second shaft to rotate, and rods connecting the wheel assembly to pneumatic cylinders;

e) a plurality of pneumatic cylinders to provide linear motion to the shaft assembly; and f) a housing enclosing the brush and shaft assembly and means for imparting linear movement and having means for attaching them to an object to be cleaned.

* * * * *